US011015412B2

(12) United States Patent
Robottom et al.

(10) Patent No.: US 11,015,412 B2
(45) Date of Patent: May 25, 2021

(54) HANGER ORIENTATION SYSTEM

(71) Applicant: Cameron International Corporation, Houston, TX (US)

(72) Inventors: Gavin Robottom, Leeds (GB); Edward Thornton, Bickerton (GB)

(73) Assignee: Cameron International Corporation, Houston, TX (US)

( * ) Notice: Subject to any disclaimer, the term of this patent is extended or adjusted under 35 U.S.C. 154(b) by 38 days.

(21) Appl. No.: 16/241,315

(22) Filed: Jan. 7, 2019

(65) Prior Publication Data

US 2020/0217165 A1 Jul. 9, 2020

(51) Int. Cl.
*E21B 33/047* (2006.01)
*E21B 33/04* (2006.01)

(52) U.S. Cl.
CPC ..... *E21B 33/0415* (2013.01); *E21B 33/047* (2013.01)

(58) Field of Classification Search
CPC ..... E21B 33/0415; E21B 33/047; E21B 33/04
See application file for complete search history.

(56) References Cited

U.S. PATENT DOCUMENTS

| | | | | |
|---|---|---|---|---|
| 4,386,656 | A | 6/1983 | Fisher et al. | |
| 5,145,006 | A * | 9/1992 | June | E21B 33/043 166/341 |
| 5,975,210 | A | 11/1999 | Wilkins et al. | |
| 6,378,613 | B1 | 4/2002 | Kent et al. | |
| 7,770,650 | B2 | 8/2010 | Young et al. | |
| 8,613,324 | B2 | 12/2013 | Nguyen | |
| 2008/0078555 | A1 | 4/2008 | Young et al. | |
| 2011/0253389 | A1 | 10/2011 | Nguyen | |
| 2015/0259990 | A1 * | 9/2015 | June | E21B 19/002 166/341 |

OTHER PUBLICATIONS

PCT International Search Report and Written Opinion; Application No. PCT/US2020/012068; dated Apr. 27, 2020; 11 pages.

* cited by examiner

*Primary Examiner* — Brad Harcourt
(74) *Attorney, Agent, or Firm* — Fletcher Yoder, P.C.

(57) ABSTRACT

A system that includes a hanger orientation system that orients a tubing hanger within a wellhead. The hanger orientation system includes a conduit defining a first end and a second end opposite the first end. A sleeve couples to the conduit. The sleeve defines a spiral groove that engages a pin to rotate the tubing hanger.

20 Claims, 7 Drawing Sheets

HANGER ORIENTATION SYSTEM

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Natural resources, such as oil and gas, are used as fuel to power vehicles, heat homes, and generate electricity, in addition to various other uses. Once a desired resource is discovered below the surface of the earth, drilling and production systems are employed to access and extract the resource. These systems may be located onshore or offshore depending on the location of a desired resource. Further, such systems generally include a wellhead through which the resource is extracted. These wellheads may have wellhead assemblies that include a wide variety of components and/or conduits, such as a tubing string, hangers, valves, and fluid conduits that facilitate drilling and/or extraction operations. For example, the tubing string may facilitate the flow of the natural resource from the formation toward surface production facilities. A tubing hanger may be provided within the wellhead to support the tubing string. Unfortunately, proper alignment of the tubing hanger in the wellhead may involve repeated run attempts with a running tool in order to matchup the hanger side outlet with a spool tree outlet.

BRIEF DESCRIPTION

In one embodiment, a mineral extraction system that includes a tubing hanger that couples to and supports a tubing string. The tubing hanger defines an outlet. A running tool couples to the tubing hanger to lower the tubing hanger into a wellhead. A hanger orientation system orients the tubing hanger within the wellhead. The hanger orientation system includes a hanger orientation device coupled to the running tool. The hanger orientation device defines a spiral groove. A pin engages the spiral groove on the hanger orientation device to rotate the tubing hanger within the wellhead.

In another embodiment, a system that includes a hanger orientation system that orients a tubing hanger within a wellhead. The hanger orientation system includes a conduit defining a first end and a second end opposite the first end. A sleeve couples to the conduit. The sleeve defines a spiral groove that engages a pin to rotate the tubing hanger.

In another embodiment, a method that includes coupling a hanger orientation device to a running tool. The method extends a pin with an actuator. The method also moves the hanger orientation device past the pin in a first direction. The pin contacts and rotates the hanger orientation device and the running tool to orient a hanger.

BRIEF DESCRIPTION OF THE DRAWINGS

Various features, aspects, and advantages of the present disclosure will become better understood when the following detailed description is read with reference to the accompanying figures in which like characters represent like parts throughout the figures, wherein.

DETAILED DESCRIPTION OF SPECIFIC EMBODIMENTS

Reference will now be made in detail to specific embodiments illustrated in the accompanying drawings and figures. In the following detailed description, numerous specific details are set forth in order to provide a thorough understanding of the disclosure. However, it will be apparent to one of ordinary skill in the art that embodiments may be practiced without these specific details. In other instances, well-known methods, procedures, components, have not been described in detail so as not to unnecessarily obscure aspects of the embodiments.

It will also be understood that, although the terms first, second, etc. may be used herein to describe various elements, these elements should not be limited by these terms. These terms are only used to distinguish one element from another. For example, a first object could be termed a second object, and, similarly, a second object could be termed a first object, without departing from the scope of the present disclosure.

The terminology used herein is for the purpose of describing particular embodiments only and is not intended to be limiting. As used in the description and the appended claims, the singular forms "a," "an" and "the" are intended to include the plural forms as well, unless the context clearly indicates otherwise. It will also be understood that the term "and/or" as used herein refers to and encompasses any and possible combinations of one or more of the associated listed items. It will be further understood that the terms "includes," "including," "comprises" and/or "comprising," when used in this specification, specify the presence of stated features, integers, steps, operations, elements, and/or components, but do not preclude the presence or addition of one or more other features, integers, operations, elements, components, and/or groups thereof. Further, as used herein, the term "if" may be construed to mean "when" or "upon" or "in response to determining" or "in response to detecting," depending on the context The present disclosure includes a hanger orientation system that facilitates alignment of a tubing hanger in a wellhead. As will be explained below, the hanger orientation system couples to a running tool that runs/lowers the tubing hanger into the wellhead. As the running tool is lowered with the landing string the hanger orientation system rotates the landing string and by extension the tubing hanger to orient the tubing hanger in the wellhead. The hanger orientation system facilitates alignment of an aperture (e.g., hanger side outlet) in the tubing hanger with an aperture in the wellhead (e.g., a spool tree outlet) to facilitate the flow of hydrocarbons (e.g., oil and/or natural gas) out of the well. More specifically, the hanger orientation may enable pre-alignment of the tubing hanger to facilitate coupling between a tubing hanger key (e.g., protrusion) and a key way in the wellhead (e.g., groove).

Figure 1:
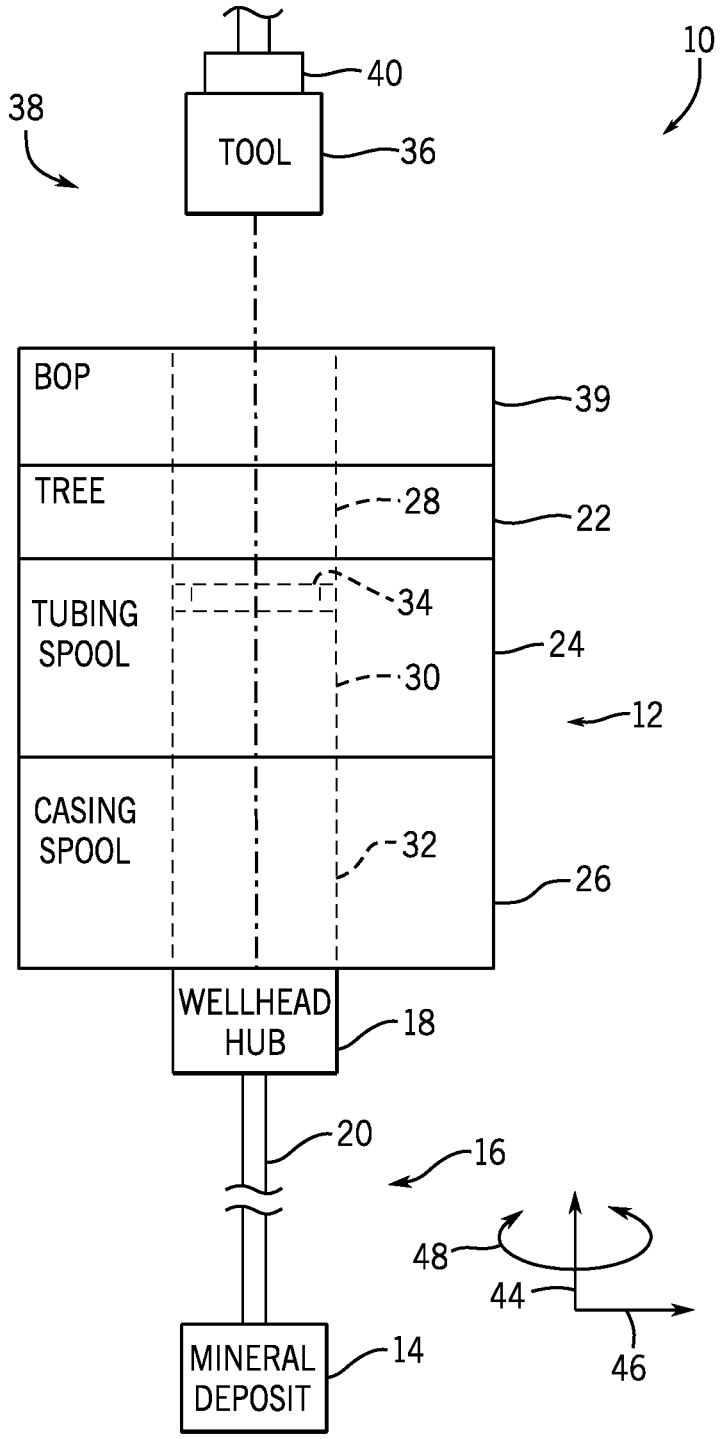
FIG. 1 is a block diagram of a mineral extraction system, in accordance with an embodiment of the present disclosure.

FIG. 1 is a block diagram of an embodiment of a mineral extraction system 10. The illustrated mineral extraction system 10 may be configured to extract various minerals and natural resources, including hydrocarbons (e.g., oil and/or natural gas), from the earth, or to inject substances into the earth. As illustrated, the mineral extraction system 10 includes a wellhead 12 coupled to a mineral deposit 14 via a well 16. The well 16 may include a wellhead hub 18 and a well bore 20. The wellhead hub 18 generally includes a large diameter hub disposed at the termination of the well bore 20 and is configured to connect the wellhead 12 to the well 16. As will be appreciated, the well bore 20 may contain elevated pressures. For example, the well bore 20 may include pressures that exceed 10,000, 15,000, or even 20,000 pounds per square inch (psi). Accordingly, the mineral extraction system 10 may employ various mechanisms, such as seals, plugs, and valves, to control and regulate the well 16. For example, plugs and valves are employed to regulate the flow and pressures of fluids in various bores and channels throughout the mineral extraction system 10.

In the illustrated embodiment, the mineral extraction system 10 includes a tree 22, a tubing spool 24, a casing spool 26, and a blowout preventer (BOP) 39. The tree 22 generally includes a variety of flow paths (e.g., bores), valves, fittings, and controls for operating the well 16. For instance, the tree 22 may include a frame that is disposed about a tree body, a flow-loop, actuators, and valves. Further, the tree 22 may provide fluid communication with the well 16. For example, the tree 22 includes a tree bore 28 that provides for completion and workover procedures, such as the insertion of tools into the well 16, the injection of various chemicals into the well 16, and so forth. Further, minerals extracted from the well 16 (e.g., oil and natural gas) may be regulated and routed via the tree 22. For instance, the tree 22 may be coupled to a flowline that is tied back to other components, such as a manifold. Accordingly, produced minerals flow from the well 16 to the manifold via the wellhead 12 and/or the tree 22 before being routed to shipping or storage facilities.

As shown, the tubing spool 24 may provide a base for the tree 22 and includes a tubing spool bore 30 that connects (e.g., enables fluid communication between) the tree bore 28 and the well 16. As shown, the casing spool 26 may be positioned between the tubing spool 24 and the wellhead hub 18 and includes a casing spool bore 32 that connects (e.g., enables fluid communication between) the tree bore 28 and the well 16. Thus, the tubing spool bore 30 and the casing spool bore 32 may provide access to the well bore 20 for various completion and workover procedures. The BOP 39 may consist of a variety of valves, fittings, and controls to prevent oil, gas, or other fluid from exiting the well in the event of an unintentional release of pressure or an overpressure condition.

As shown, a tubing hanger 34 is positioned within the tubing spool 24. The tubing hanger 34 may be configured to support tubing (e.g., production tubing) that is suspended in the well bore 20 and/or to provide a path for control lines, hydraulic control fluid, chemical injections, and so forth. In the illustrated embodiment, the mineral extraction system 10 includes a tool 36, such as a tubing hanger running tool (THRT) or a rotatable tubing hanger running tool (RTHRT). The tool 36 may be configured to be lowered (e.g., run) toward the wellhead 12 (e.g., via a crane or other supporting device). In order to align the tubing hanger 34 in the wellhead 12, a hanger orientation device 40 may be coupled to the running tool 36. To facilitate the discussion below, the mineral extraction system 10, and the components therein, may be described with reference to an axial axis or direction 44, a radial axis or direction 46, and a circumferential axis or direction 48.

Figure 2:
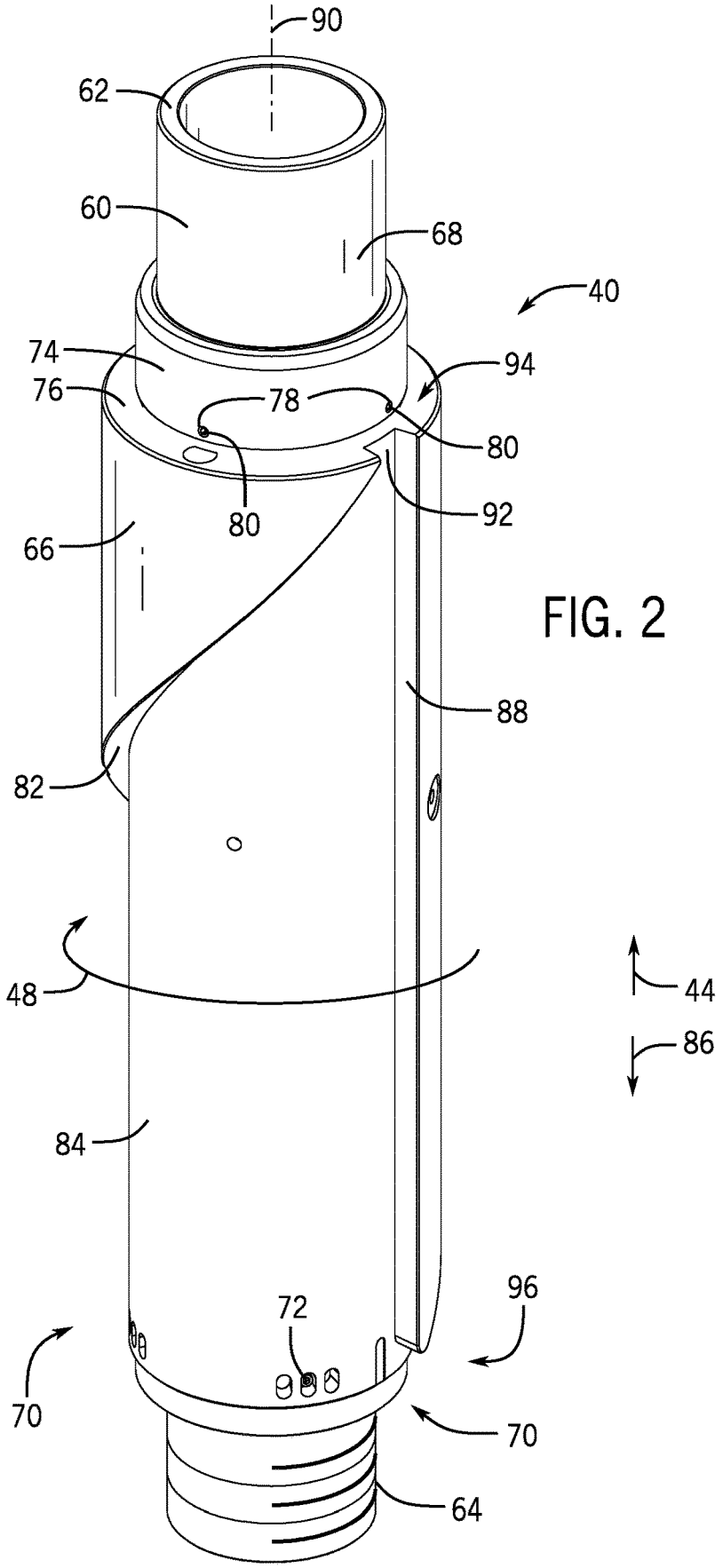
FIG. 2 is a perspective side view of a hanger orientation system, in accordance with an embodiment of the present disclosure.

FIG. 2 is a perspective side view of an embodiment of a hanger orientation device 40 of the hanger orientation system 38. The hanger orientation device 40 includes a conduit 60 that defines first and second ends 62 and 64. The first end 62 enables the hanger orientation device 40 to couple to a landing string, which lowers the hanger orientation device 40 into the wellhead 12. The second end 64 enables the hanger orientation device 40 to couple to the running tool 36, seen in FIG. 1. The first and second ends 62, 64 of the conduit 60 may include internal and/or external threads in order to couple to the respective landing string and the running tool 36. In some embodiments, the first and second ends 62, 64 may include different connectors that enable the hanger orientation device 40 coupled to the landing string and to the running tool 36.

By coupling to the landing string and the running tool 36 instead of the tubing hanger 34, the hanger orientation device 40 may not increase the height of the tubing hanger 34 within the wellhead 12. Furthermore, the hanger orientation device 40 may therefore also be reused in aligning other tubing hangers in their respective wellheads.

In some embodiments, the hanger orientation device 40 may include a sleeve 66 that couples to an external surface 68 of the conduit 60. The sleeve 66 may include a plurality of apertures 70 that extend circumferentially around the sleeve 66. These apertures 70 enable one or more fasteners 72 to extend through the sleeve 66 to couple the sleeve 66 to the conduit 60. As illustrated, the apertures 70 may be formed in sets of three that are offset from neighboring sets by 90°. However, it should be understood that the aperture sets may have different numbers of apertures 70 (e.g., 1, 2, 3, 4, 5). The aperture sets may also be offset by a different distance from each other about the circumference of the sleeve 66 (e.g., 15°, 25°, 45°, 60°, 90°, 120°, 180°. In some embodiments, the hanger orientation device 40 may include a collar 74 that couples to the conduit 60 and contacts an end 76 of the sleeve 66 to block removal of the sleeve 66 from the conduit 60 in longitudinal direction 44. The collar 74 may threadingly couple to the conduit 60 and/or include apertures 78 that receive fasteners 80 (e.g., threaded fasteners) that enable the collar 74 to couple to the conduit 60. In some embodiments, the conduit 60 and sleeve 66 may not be separately coupled components. Instead, the conduit 60 and sleeve 66 may be one-piece (e.g., integral).

As illustrated, the sleeve 66 defines a spiral groove 82 in an exterior surface 84. In some embodiments, the spiral groove 82 may be a helix/helical groove. As will be explained below, the spiral groove 82 is configured to contact a pin 132 that slides along the groove 82 as the hanger orientation device 40 moves in direction 86. The contact between the pin 132 and the spiral groove 82 drives rotation of the hanger orientation device 40 in circumferential direction 48. As the hanger orientation device 40 continues to move in direction 86, the pin 132 continues to rotate the hanger orientation device 40 until the pin 132 contacts a lip 88 (e.g., longitudinal lip) that extends along a longitudinal axis 90 of the sleeve 66. The lip 88 blocks further rotation of the hanger orientation device 40 in order to block misalignment of the tubing hanger 34 through over rotation. As the hanger orientation device 40 continues to move in direction 86, the pin 132 slides through a longitudinal groove 92 in the sleeve 66 enabling the hanger orientation device 40 to move past the pin 132 once the hanger 34 reaches the desired orientation. In some embodiments, the longitudinal lip 88 may extend from a first end 94 of the sleeve 66 to a second end of the sleeve 96. In still other embodiments, the longitudinal lip 88 may extend over a portion of the length of the sleeve 66.

Figure 3:
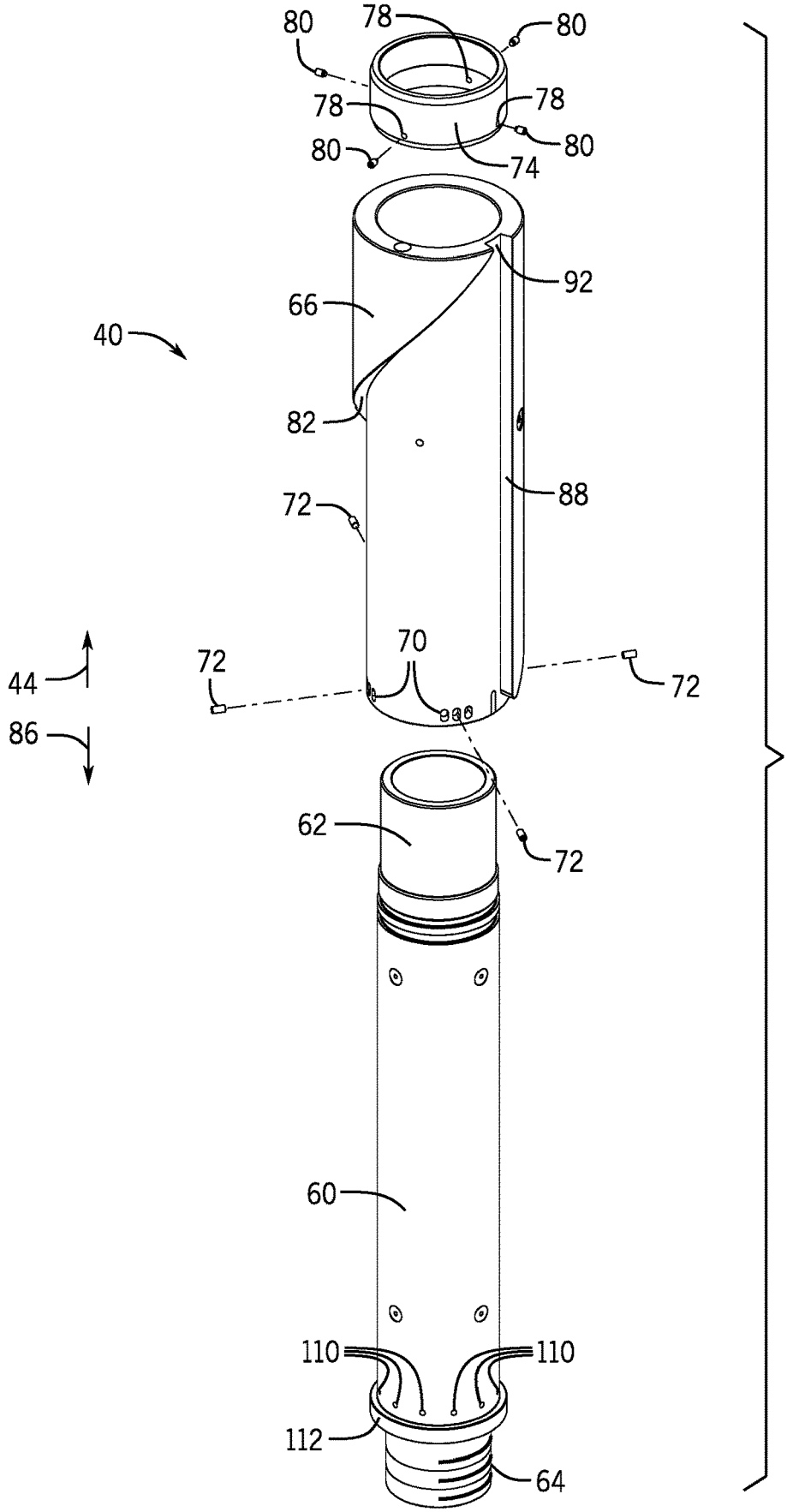
FIG. 3 is an exploded view of the hanger orientation system of FIG. 2, in accordance with an embodiment of the present disclosure.

FIG. 3 is an exploded view of an embodiment of the hanger orientation device 40 of FIG. 2. As explained above, the sleeve 66 may include a plurality of apertures 70 that extend circumferentially around the sleeve 66. These apertures 70 enable one or more fasteners 72 to extend through the sleeve 66 to couple the sleeve 66 to the conduit 60. Specifically, the fasteners 72 extend into apertures 110 on the conduit 60. These apertures 110 enable the sleeve 66 to couple to the conduit 60 in a specific orientation. That is, the sleeve 66 may be rotated about the conduit 60 until the groove 82 of the sleeve 66 is in a desired circumferential orientation with respect to the conduit 60. Once properly oriented, the fasteners 72 may extend through the apertures 70 in the sleeve 66 and into the apertures 110 in the conduit 60 to block rotation of the sleeve 66 with respect to the conduit 60. By rotating the sleeve 66 about the conduit 60 prior to coupling with the fasteners 72, the hanger orientation device 40 may block and/or reduce excess rotation of the running tool 36 and the landing string during the hanger landing process. The hanger orientation system 38 may therefore facilitate alignment of the tubing hanger 34 while simultaneously block/reducing interference between equipment proximate to and/or coupled to a top end of the landing string.

As illustrated, the apertures 110 may be evenly or unevenly spaced about the conduit 60. For example, the apertures 70 may be spaced about the conduit 60 in intervals of 5°-10°, 5°-20°, 5°-45°, etc. In some embodiments, conduit 60 may define a circumferential lip 112 proximate the second end 64. The lip 112 enables the sleeve 66 to rest on the conduit 60 to align the apertures 110 and 70 as the sleeve 66 is rotated about the conduit 60. In other words, the lip 112 blocks movement of the sleeve 66 in direction 86 to facilitate rotational alignment of the apertures 70 in the sleeve 66 with apertures 110 in the conduit 60.

Figure 4:
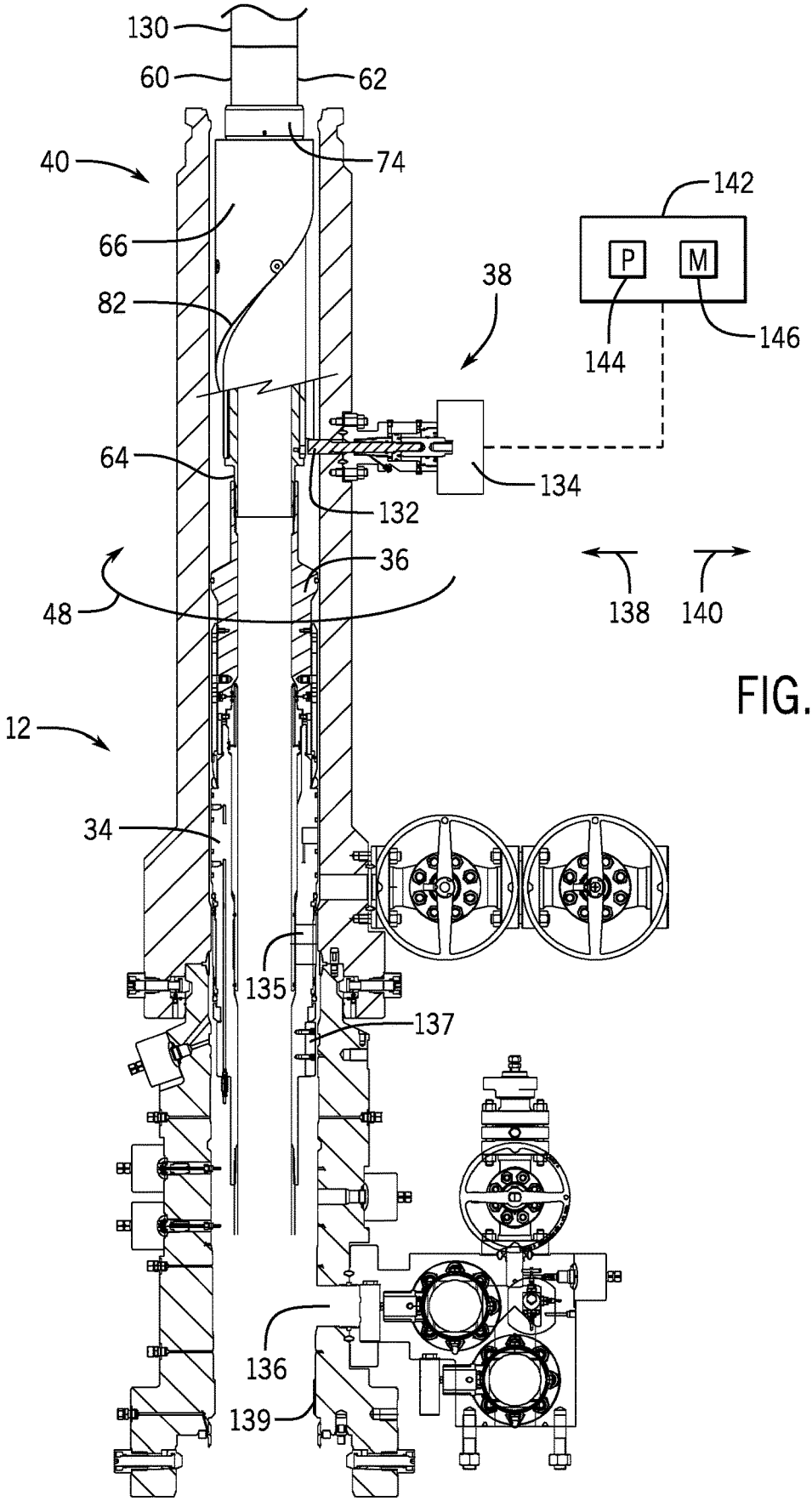
FIG. 4 is a partial cross-sectional view of a tubing hanger and a hanger orientation system being lowered into a wellhead, in accordance with an embodiment of the present disclosure.

FIG. 4 is a partial cross-sectional view of a tubing hanger 34 and a hanger orientation device 40 being lowered into the wellhead 12. As illustrated, the hanger orientation device 40 couples to the landing string 130 at the first end 62 of the conduit 60. The second end 64 of the conduit 60 couples to the running tool 36, which in turn couples to the tubing hanger 34. In this way, the hanger orientation system 38 does not increase the height of the tubing hanger 34 within the wellhead 12 after installation. In other words, the hanger orientation device 40 is withdrawn from the wellhead 12 after orienting the tubing hanger 34 within the wellhead 12. The hanger orientation device 40 may therefore be reused to set additional tubing hangers in other wellheads.

As the tubing hanger 34 is lowered into the wellhead 12, the sleeve 66 of the hanger orientation device 40 contacts a pin 132. More specifically, the pin 132 is configured to contact the spiral groove 82 on the sleeve 66. As explained above, contact between the pin 132 and the spiral groove 82 drives rotation of the hanger orientation device 40, which in turn rotates the running tool 36 and the hanger 34 in circumferential direction 48. It should be understood that depending on the orientation of the spiral groove 82 rotation caused by contact between the pin 132 and the spiral groove 82 may rotate the hanger orientation device 40 in the opposite circumferential direction. As the hanger 34 rotates, an aperture 135 (e.g., production outlet) in the hanger 34 aligns with an aperture 136 in the wellhead 12 enabling oil and/or natural gas to exit the wellhead 12 through the hanger 34. More specifically, the hanger orientation device 40 enables pre-alignment of a tubing hanger key 137 (e.g., protrusion) with a keyway 139 (e.g., groove), which may finalize alignment of the hanger 34 in the wellhead 12.

The pin 132 is controlled with an actuator 134 that extends and retracts the pin 132 in directions 138 and 140. The actuator 134 may be a pneumatic actuator, a hydraulic actuator, an electric actuator, a manual actuator, or a combination thereof. The actuator 134 may be controlled with a controller 142. The controller 142 may include a processor 144 and memory 146. For example, the processor 144 may be a microprocessor that executes software to control various valves and/or motors to activate the actuator 134. The processor 144 may include multiple microprocessors, one or more "general-purpose" microprocessors, one or more special-purpose microprocessors, and/or one or more application specific integrated circuits (ASICs), field-programmable gate arrays (FPGAs), or some combination thereof. For example, the processor 144 may include one or more reduced instruction set (RISC) processors.

The memory 146 may include a volatile memory, such as random access memory (RAM), and/or a nonvolatile memory, such as read-only memory (ROM). The memory 146 may store a variety of information and may be used for various purposes. For example, the memory 146 may store processor executable instructions, such as firmware or software, for the processor 144 to execute. The memory 146 may include ROM, flash memory, a hard drive, or any other suitable optical, magnetic, or solid-state storage medium, or a combination thereof. The memory 146 may store data, instructions, and any other suitable data. In operation, the processor 144 executes instructions on the memory 146 to control the actuator 134.

Figure 5:
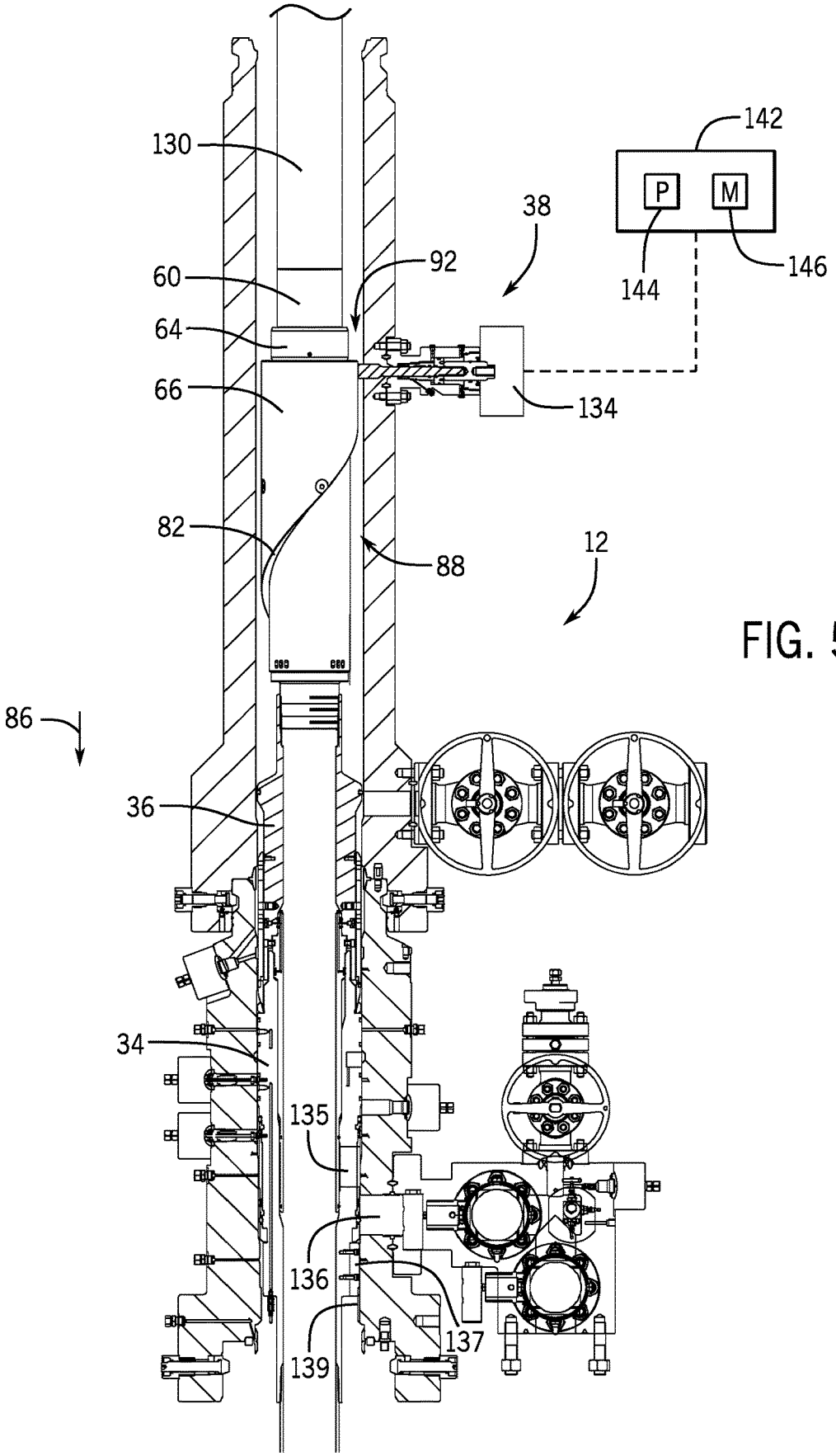
FIG. 5 is a partial cross-sectional view of the hanger orientation system rotating the tubing hanger as the tubing hanger is lowered into the wellhead, in accordance with an embodiment of the present disclosure.

FIG. 5 is a partial cross-sectional view of a tubing hanger 34 and a hanger orientation device 40 being lowered into the wellhead 12. As the tubing hanger 34 continues moving in direction 86, the spiral groove 82 continues to slide over the pin 132, which drives rotation of the hanger orientation device 40. The hanger orientation device 40 continues to rotate until the pin 132 contacts the longitudinal lip 88. The longitudinal lip 88 is configured to block further rotation of the hanger orientation device 40 and thus rotation of the running tool 36 and the hanger 34. The longitudinal lip 88 is configured to contact and block rotation of the hanger orientation device 40 when the aperture 135 in the tubing hanger 34 aligns with the aperture 136 in the wellhead 12. After alignment (e.g., pre-alignment) with the hanger orientation device 40, the tubing hanger key 137 (e.g., protrusion) slides into the keyway 139 (e.g., groove).

Figure 6:
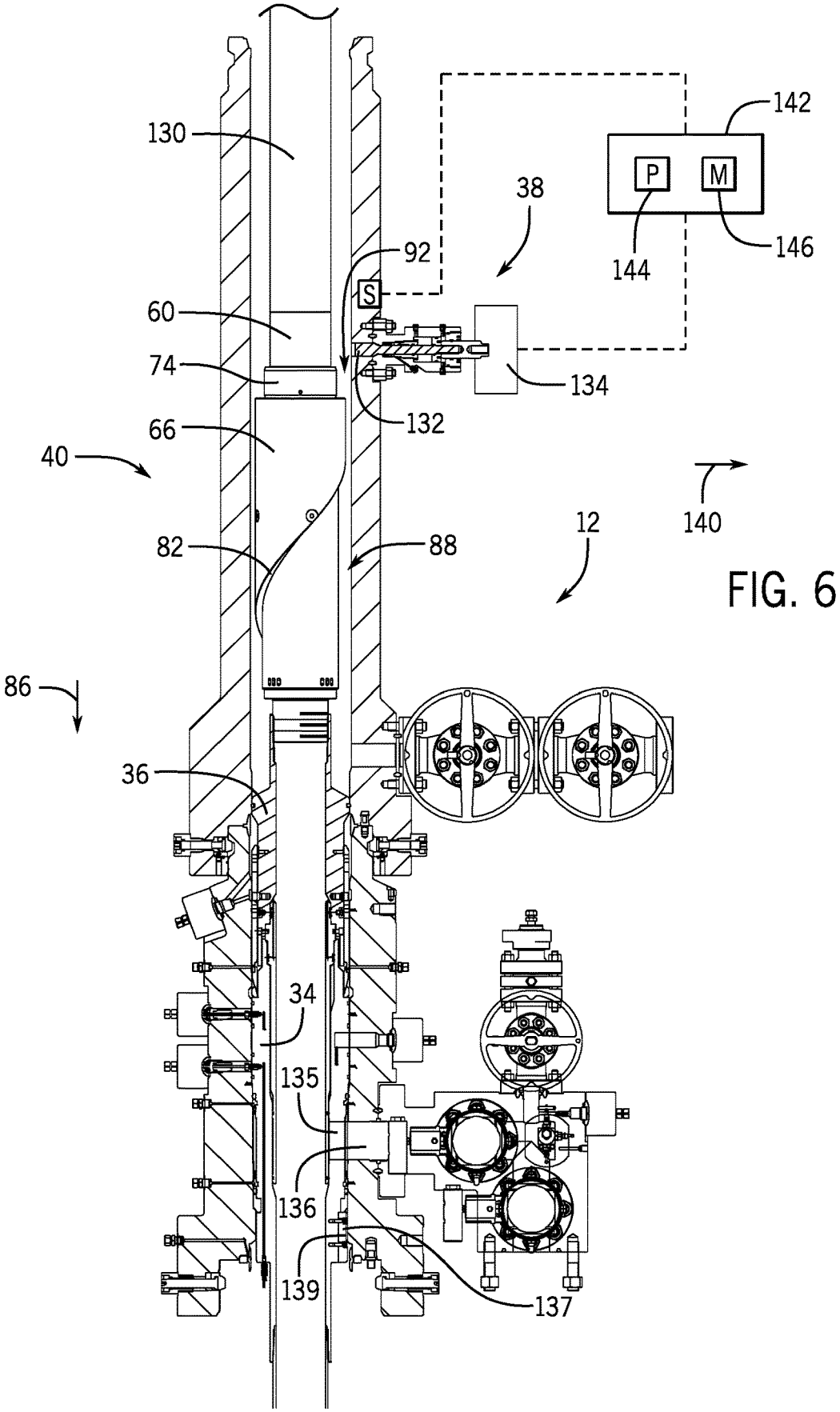
FIG. 6 is a partial cross-sectional view of the tubing hanger aligned in the wellhead, in accordance with an embodiment of the present disclosure.

FIG. 6 is a partial cross-sectional view of a tubing hanger 34 and a hanger orientation device 40 being lowered into the wellhead 12. After contacting the longitudinal lip 88, the hanger orientation device 40 continues to slide past the pin 132 enabling the pin 132 to pass through the longitudinal groove 92. The tubing hanger 34 may then be lowered the remaining distance in direction 86 enabling the tubing hanger key 137 (e.g., protrusion) to slide in the keyway 139 (e.g., groove), which may finalize alignment of the aperture 135 with the aperture 136 in the wellhead 12. After the hanger orientation device 40 passes the pin 132, the pin 132 may be retracted in direction 140 to facilitate retraction of the hanger orientation device 40 and the running tool 36. In some embodiments, the controller 142 may couple to a sensor(s) 150 that detects the position of the hanger orientation device 40. When the sensor 150 detects that the hanger orientation device 40 has passed the pin 132, the controller 142 actuates the actuator 134 to retract the pin 132.

Figure 7:
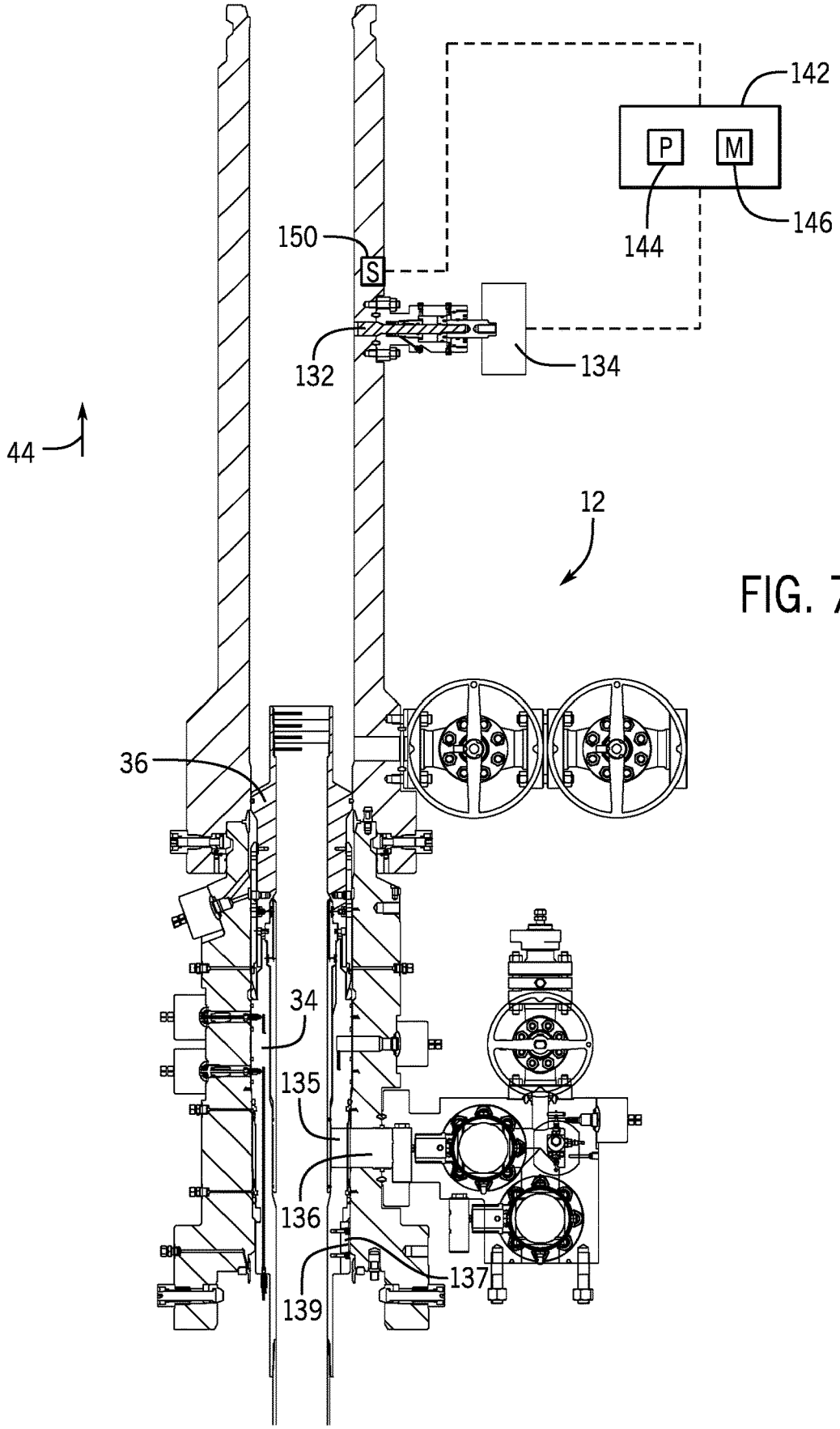
FIG. 7 is a partial cross-sectional view of the tubing hanger coupled to the wellhead, in accordance with an embodiment of the present disclosure.

FIG. 7 is a partial cross-sectional view of the tubing hanger 34 coupled to the wellhead 12. After aligning the aperture 135 in the tubing hanger 34 with the aperture 136 in the wellhead 12, the tubing hanger 34 may be set with the running tool 36. The running tool 36, hanger orientation device 40, and landing string 130 may be then be disconnected from the hanger 34 and withdrawn and used to align another tubing hanger in another wellhead.

As used herein, the terms "inner" and "outer"; "up" and "down"; "upper" and "lower"; "upward" and "downward"; "above" and "below"; "inward" and "outward"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members."

The foregoing description, for purpose of explanation, has been described with reference to specific embodiments. However, the illustrative discussions above are not intended to be exhaustive or to limit the disclosure to the precise forms disclosed. Many modifications and variations are possible in view of the above teachings. Moreover, the order in which the elements of the methods described herein are illustrated and described may be re-arranged, and/or two or more elements may occur simultaneously. The embodiments were chosen and described in order to best explain the principals of the disclosure and its practical applications, to thereby enable others skilled in the art to best utilize the disclosure and various embodiments with various modifications as are suited to the particular use contemplated.

The invention claimed is:

1. A system, comprising:

a hanger orientation system configured to orient a tubing hanger within a wellhead, the hanger orientation system comprising:

a hanger orientation device configured to couple to a running tool for the tubing hanger, wherein the hanger orientation device defines a spiral groove and an axial lip, and the axial lip extends along at least a portion of an axial length of the spiral groove; and a pin configured to engage the spiral groove on the hanger orientation device to rotate the tubing hanger within the wellhead while moving the tubing hanger in a downward direction toward an installation position of the tubing hanger in the wellhead, wherein the pin is configured to engage the axial lip to block rotation of the tubing hanger.

2. The system of claim 1, wherein the hanger orientation device comprises a conduit and a sleeve coupled to an outer surface of the conduit.

3. The system of claim 2, wherein the conduit defines a first end and a second end opposite the first end, and wherein the first end is configured to couple to the running tool and the second end is configured to couple to a landing riser.

4. The system of claim 2, wherein the sleeve defines the spiral groove.

5. The system of claim 4, wherein the sleeve defines a groove on the sleeve configured to receive the pin and to enable the sleeve to slide past the pin.

6. The system of claim 2, wherein the sleeve couples to the conduit with a fastener.

7. The system of claim 1, wherein the spiral groove comprises a downwardly facing spiral surface.

8. The system of claim 1, comprising an actuator coupled to the pin, wherein the actuator is configured to extend and retract the pin.

9. The system of claim 1, comprising the tubing hanger, the running tool, the wellhead, or a combination thereof.

10. The system of claim 1, wherein the spiral groove is a helix.

11. A system, comprising:

a hanger orientation system configured to orient a tubing hanger within a wellhead, the hanger orientation system comprising:

a conduit defining a first end and a second end opposite the first end; and a sleeve coupled to the conduit, wherein the sleeve defines a spiral groove and an axial lip, the axial lip extends along at least a portion of an axial length of the spiral groove, the spiral groove is configured to engage a pin to rotate the tubing hanger while moving the tubing hanger in a downward direction toward an installation position of the tubing hanger in the wellhead, and the axial lip is configured to engage the pin to block rotation of the tubing hanger.

12. The system of claim 11, wherein the conduit and the sleeve are one-piece.

13. The system of claim 11, wherein the conduit and the sleeve couple together with a fastener.

14. The system of claim 11, wherein the first end and the second end comprise threads, and wherein the first end is configured to couple to a running tool and the second end is configured to couple to a landing string.

15. The system of claim 11, comprising a groove on the sleeve configured to receive the pin and to enable the sleeve to slide past the pin.

16. The system of claim 11, comprising the pin and an actuator configured to extend and retract the pin.

17. A method, comprising:

coupling a hanger orientation device to a running tool, wherein the hanger orientation device comprises a spiral groove and an axial lip, and the axial lip extends along at least a portion of an axial length of the spiral groove;

extending a pin with an actuator; and moving the hanger orientation device in a downward direction to engage the pin along the spiral groove and rotate the hanger orientation device and the running tool to orient a hanger, wherein the axial lip engages the pin to block rotation of the hanger orientation device and the running tool.

18. The method of claim 17, wherein moving the hanger orientation device in the downward direction further comprises setting the hanger within a wellhead.

19. The method of claim 18, comprising retracting the pin with the actuator and moving the hanger orientation device in an upward direction to retrieve the hanger orientation device and the running tool after setting the hanger.

20. The method of claim 17, wherein moving the hanger orientation device in the downward direction comprises passing the pin through an axial groove on the hanger orientation device after engagement along the spiral groove.

* * * * *